US005180482A

United States Patent [19]

Abys et al.

[11] Patent Number: 5,180,482

[45] Date of Patent: Jan. 19, 1993

[54] THERMAL ANNEALING OF PALLADIUM ALLOYS

[75] Inventors: Joseph A. Abys, Warren; Igor V. Kadija, Ridgewood; Joseph J. Maisano, Jr., Denville; Shohei Nakahara, North Plainfield, all of N.J.

[73] Assignee: AT&T Bell Laboratories, Murray Hill, N.J.

[21] Appl. No.: 733,492

[22] Filed: Jul. 22, 1991

[51] Int. Cl.[5] ..... C25D 5/50

[52] U.S. Cl. ..... 205/224; 205/257; 205/265

[58] Field of Search ..... 204/37.1, 44.6, 47; 205/257, 265, 224

[56] References Cited

U.S. PATENT DOCUMENTS

| | | | |
|---|---|---|---|
| 3,925,170 | 9/1975 | Skomoroski et al. | 205/257 |
| 4,066,517 | 1/1978 | Stevens et al. | 205/257 |
| 4,076,599 | 2/1978 | Caricchio et al. | 204/47 |
| 4,319,967 | 3/1982 | Vratny et al. | 204/37.1 |
| 4,468,296 | 8/1984 | Abys et al. | 204/47 |
| 4,486,274 | 12/1984 | Abys et al. | 205/257 |
| 4,911,798 | 3/1990 | Abys et al. | 205/257 |
| 4,911,799 | 3/1990 | Abys et al. | 204/47 |

*Primary Examiner*—John Niebling
*Assistant Examiner*—Kishor Mayekar
*Attorney, Agent, or Firm*—O. E. Alber

[57] ABSTRACT

This invention is concerned with production of electrical devices comprising an electrodeposited conductive region free from cracking defects. In the production of a contact portion of the device from a metal strip electroplated with a conductive stripe of an alloy, the stripe exhibited, upon stamping and forming operation, cracked areas. Typically, the stripe coating on the metal strip, such as a copper bronze material, includes a layer of nickel, a layer of palladium alloyed with nickel, cobalt, arsenic or silver, and a flash coating of hard gold. The cracking defects were eliminated by subjecting the plated strip to an annealing treatment prior to the stamping and forming operation. After the heat-treatment, the stripe was free from cracks and separations between the successive layers.

8 Claims, 5 Drawing Sheets

THERMAL ANNEALING OF PALLADIUM ALLOYS

TECHNICAL FIELD

The invention is concerned with electroplated palladium alloys, especially electroplated as stripe-on-strip, for use in the fabrication of contacts in electrical devices.

BACKGROUND OF THE INVENTION

Palladium and palladium alloys are used in a number of applications because of their chemical inertness, hardness, excellent wearability, bright finish and high electrical conductivity. In addition, they do not form oxide surface coatings that might increase surface contact resistance. Particularly attractive is the use of palladium alloys as electrical contact surfaces in the electrical arts such as in electrical connectors, relay contacts, switches, etc.

Electrical contact manufacture advantageously employs a "stripe-on-stripe " processing. A metal strip, typically a copper bronze material, is coated with a stripe of a metal. To reduce an expense of precious metals the stripe is produced only on those portions of the strip which when subsequently formed into an electrical connector will be subjected to extended wear and requires superior electrical connection characteristics. Following the coating application, the metal strip is subjected to stamping and forming operations.

The process of coating the strip with a stripe of contact material can be performed in several ways including an inlaying method and an electroplating method. The inlaying method calls for metal cladding of a metal substrate with an inlay of a noble metal or alloy. In the inlaying method a strip of a substrate metal is inlayed with a stripe of an alloy followed by capping with gold. For example, a strip of copper-bronze alloy is inlayed with 40/60 Ag/Pd alloy about 90 microinches thick followed by a 10 microinch thick Au capping. The inlayed strip is then stamped and formed into a connector. The alloy material is expensive and, unfortunately, the inlayed stripe wears out faster than is desirable. The electroplating method consists of electroplating a strip of the copper bronze substrate with a stripe of protective coating, including electrodeposition of Pd alloyed with Ni or Co, followed by Au capping, typically in a reel-to-reel operation. A suitable process for electroplating palladium and palladium alloys from an aqueous solution is described in a number of U.S. patents granted to J. A. Abys and including U.S. Pat. No. 4,468,296 issued on Aug. 28, 1984; U.S. Pat. No. 4,486,274 issued on Dec. 4, 1984; and U.S. Pat. Nos. 4,911,798 and 4,911,799, both issued on Mar. 27, 1990, each of which is incorporated herein by reference. The stripe-coated strip is then subjected to the stamping and forming operation. The total amount of precious metals deposited in the electroplating process is small and the process is less costly than the inlaying process. Therefore, a device with an electrical contact produced with electroplated stripe would be less costly than with the inlayed stripe, even if being equal in other aspects.

Applicants have observed, however, that electrodeposits of alloys, for instance hard gold, palladium nickel or palladium cobalt alloy, exhibited undesirable cracking defects when subjected to the forming operation as required in the production of such devices. Therefore, it is desirable to alleviate these undesirable characteristics of the electroplated palladium alloy stripe.

SUMMARY OF THE INVENTION

This invention is concerned with production of electrical devices comprising an electrodeposited conductive region free from cracking defects. In the production of a contact portion of the device from a metal strip electroplated with a conductive stripe of an alloy, the stripe exhibited, upon stamping and forming operation, cracked areas. Typically, the stripe coating on the metal strip, such as a copper bronze material, includes a layer of nickel, a layer of palladium alloyed with nickel, cobalt, arsenic or silver, and a flash coating of hard gold. The cracking defects were eliminated by subjecting the plated strip to an annealing treatment prior to the stamping and forming operation. After the heat-treatment, the stripe was free from cracks and separations between the successive layers.

DETAILED DESCRIPTION

Figure 1:
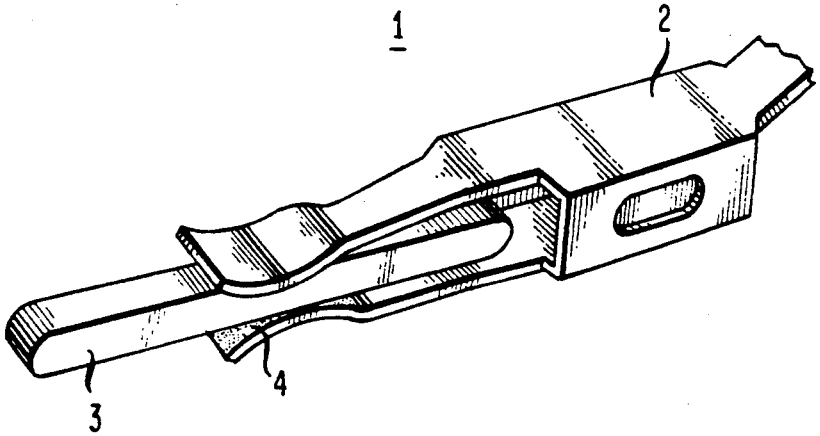
FIG. 1 is a schematic representation of a connector and a mating pin in which mating contact surfaces are electroplated with a metal comprising palladium alloy.

In FIG. 1 is shown a schematic representation of an electrical connector, 1, having a connector body, 2, and a mating pin, 3. Surfaces, 4, of the connector body mating with the pin are electroplated with metal, comprising a palladium alloy and an overlay of hard gold.

Figure 2:
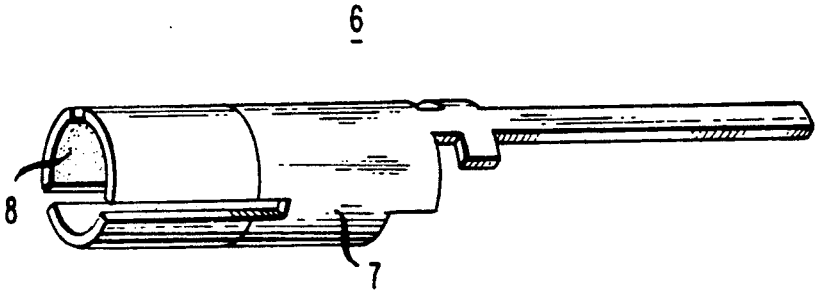
FIG. 2 is a schematic representation of a connector pin, the inside of one end of which is coated with electroplated metal comprising palladium alloy.

In FIG. 2 is shown a schematic representation of a connector pin, 6, one portion of which is formed into a cylindrical configuration, 7, an inside surface of end portion of which is coated with electroplated metal, 8, comprising a palladium alloy and an overlay of hard gold.

In the production of electrical connectors, a strip base metal, such as a copper-nickel-tin alloy No. 725 (88.2 Cu, 9.5 Ni, 2.3 Sn; ASTM Spec. No. B122) provided with a 50–70 micro-inch thick layer of nickel, typically electroplated from a nickel sulfamate bath, is coated with a 20–30 micro-inch thick layer of palladium alloy followed by a 3-5 micro-inch thick flash coating of hard gold, such as a cobalt-hardened gold typically electroplated from a slightly acidic solution comprising gold cyanide, cobalt citride and a citric buffer. The palladium alloy is electroplated from the bath and under conditions described in the Abys patents (supra.), especially U.S. Pat. No. 4,911,799. Typically, palladium alloys for this use are made up from 20 to 80 mole percent palladium, remainder being nickel, cobalt, arsenic or silver, with nickel and cobalt being a preferred and nickel being the most preferred alloying metal.

The palladium alloy plating bath may be prepared by adding to an aqueous solution of a complexing agent, a source of palladium and of an alloying agent, e.g. $PdCl_2$ and $NiCl_2$, respectively, stirring, optionally heating, filtering and diluting the solution to a desired concentration. The palladium molar concentration in the bath typically may vary from 0.001 to saturation, with 0.01 to 1.0 being preferred, and 0.1 to 0.5 being most preferred. To this solution buffer is added (e.g. equal molar amounts of $K_3PO_4$ or $NH_4Cl$) and the pH is adjusted up by the addition of KOH and down by the addition of $H_3PO_4$ or HCl. Other buffer and pH-adjusting agents may be used as is well-known in the art. Typically, pH values of the bath are between 5 and 14, with pH from 7 to 12 being more preferred and 7.5 to 10 being most preferred. Plating at current densities as high as 200, 500 or even 2000 ASF for high-speed plating yield excellent results as do lower plating current densities of 0.01 to 50 or even 100 to 200 ASF typically used for low-speed plating. Sources of palladium may be selected from $PdCl_2$, $PdBr_2$, $PdI_2$, $PdSO_4$, $Pd(NF_3)_2Cl_2$, $Pd(NH_3)_2Br_2$, $Pd(NH_3)_2I_2$, and tetrachloropallades (e.g. $K_2PdCl_4$), with $PdCl_2$ being preferred. The complexing agents may be selected form ammonia and alkyl diamines, including alkyl hydroxyamines with up to 50 carbon atoms, with up to 25 carbon atoms being preferred and up to 10 carbon atoms being most preferred. Alkyl hydroxyamines selected from bis-(hydroxymethyl)aminomethane, tris-(hydroxymethyl)aminomethane, bis-(hydroxyethyl)aminomethane and tris-(hydroxyethyl)aminomethane are among the most preferred alkyl hydroxyamines.

Normally, the electroplated deposits are well adhering and ductile. However, it was discovered that under certain forming operation conditions the electroplated PdNi alloy coating unexpectedly exhibited cracks. The forming operation conditions include bending the electroplated strip such that the elongation of the electroplated coating on the outer surface of the contact e.g. surface 4 (FIG. 1), is in excess of 10% or such that the inside diameter of the formed contact portion (FIG. 2) is less than 2 mm.

This problem has been mitigated in accordance with the present invention by subjecting the electroplated strip, prior to the forming operation, to an annealing treatment, as described hereinbelow. During the annealing, the electroplated PdNi alloy undergoes a recrystallization process. While crystallites in the coating as electroplated are of the order of 5-10 nanometers in size, the crystallites in the thermally treated material increase to several micrometers in size with resultant increase in the ductility of the electroplated material without any measurable deterioration in the hardness of the electrodeposit. The annealed PdNi alloy-plated stripe, when subjected to the stamping and forming operation, remains free of cracking defects which develop in the thermally-untreated material. The annealing is conducted such that the properties of the underlying substrate, such as its spring characteristics, will not be affected by the anneal.

Annealing may be accomplished in numerous ways. One could be by placing a reel or reels of the electroplated metal into an annealing furnace for a time sufficient to anneal the stripe. However, in this procedure the annealing may not be effectively controlled since inner layers of the reel may take longer period to heat-up to a desired temperature than the outer layers of the reel thus leading to a possible loss of spring in the substrate material in the outer layers. A more effective way would be to advance the strip through a furnace in a reel-to-reel operation wherein each portion would successively enter the furnace, the temperature of the strip would be raised to a desired annealing temperature, held there for a period of time sufficient to complete the annealing of the electroplated deposit and upon exiting the furnace, cooled down to the room temperature. More advantageously, thermal treatment of the plated strip may be conducted in a furnace positioned at the exit from the plating line so that the plating and annealing steps are conducted in a continuous fashion. An elongated tubular furnace with a heating zone several feet long, proportioned to enable the thermal processing of the plated strip during the passage of the strip through the furnace, could be used for this purpose. The speed of advance of the strip through the furnace as well as the annealing process are programmed to coincide with the speed of advance of the strip through the plating operation. After the annealing step, the strip exits the furnace and is permitted to cool down to an ambient temperature.

The annealing includes a preheating or rise step during which the temperature rises from the environment or plating bath temperature to an optimum annealing temperature level and a holding step during which the preheated strip is held at the optimum annealing temperature level for a preselected period of time. The annealed is followed by a cooling step during which the annealed sample is permitted to cool down to room temperature. The annealing and the cooling are conducted in an inert gas atmosphere such as nitrogen, argon, helium. Of essence is the total time of the annealin, which consists of rise time to raise the temperature of the plated deposit from an environment of platng bath temperature to a hold temperature, and hold time during which the article is held at the hold temperature to complete the anneal of the deposit. Inadequate annealing shall result in stripe deposits which are insufficiently ductile and, thus, shall exhibit cracks after the stamping and forming operation. On the other hand, excessive annealing may lead to the loss of spring in the substrate. Therefore, the annealing should be conducted so as to fully anneal the strip deposit while avoiding such annealing of the metal of the substrate as to unfavorably affect its spring characteristics. Spring in the connector is needed to keep a tight contact with the other part of the connector couple, e.g. a contact between contact portion 4 and pin 3 (FIG. 1).

In the preferred exemplary embodiment, heat-treatment was performed of stripe-on-strip coated material comprising a strip base metal of a copper-nickel-tin alloy 725 (88.2 Cu, 9.5 Ni, 2.3 Sn, ASTM Spec. No. B122) having a 50-70 microinch thick layer of nickel, a 20-30 microinch thick layer of palladium-nickel alloy (20-80 Pd, preferably 80 Pd, remainder Ni) and a 3-5 microinch flash coating of hard gold. Formation of electrical connectors from this material leads to an elongation in the outer coatings of the device shown in FIG. 1 exceeding 10%; however, PdNi alloy as plated typically can sustain elongation in the range of from 6 to 10% and cannot sustain elongations of 10% or more without cracking. Applicants have discovered that unexpectedly cracking defects in this material may be eliminated by annealing of the plated deposit at or above the temperature of 380°. Differential calorimetry performed at this temperature produces recrystallization and annealing which can be detected by its exothermal reaction. Here, the typical rate of temperature rise is 5° C. per minute, thus amounting to a total anneal time of about 70 minutes. However, this rate of processing is not suitable for plating processes conducted at a plating velocity of typically 6–12 m/min. (0.1–0.2 m/sec.) Therefore, the annealing may be conducted most expeditiously by a Rapid Thermal Anneal (RTA) treatment in which a total heat treatment time, including rise and hold times, is typically limited to one minute or less. Utilizing this process, the optimum annealing temperature can be reached within a period of seconds, such as from 1 to 30 seconds or more, depending on the rate at which the temperature rises from the initial to the optimum annealing temperature and holding of the deposit at that temperature for a period of from 1 to 30 seconds or more. The most efficient annealing of the coating is achieved if RTA is performed with a rapid rise temperature, that is a rise in degrees per interval of time from the temperature of the plated strip to the optimum annealing temperature. Typically, shorter rise times involving sharp rise to the annealing temperature, are more successful in achieving the appropriate annealing of PdNi coating than longer rise times.

Figure 3:
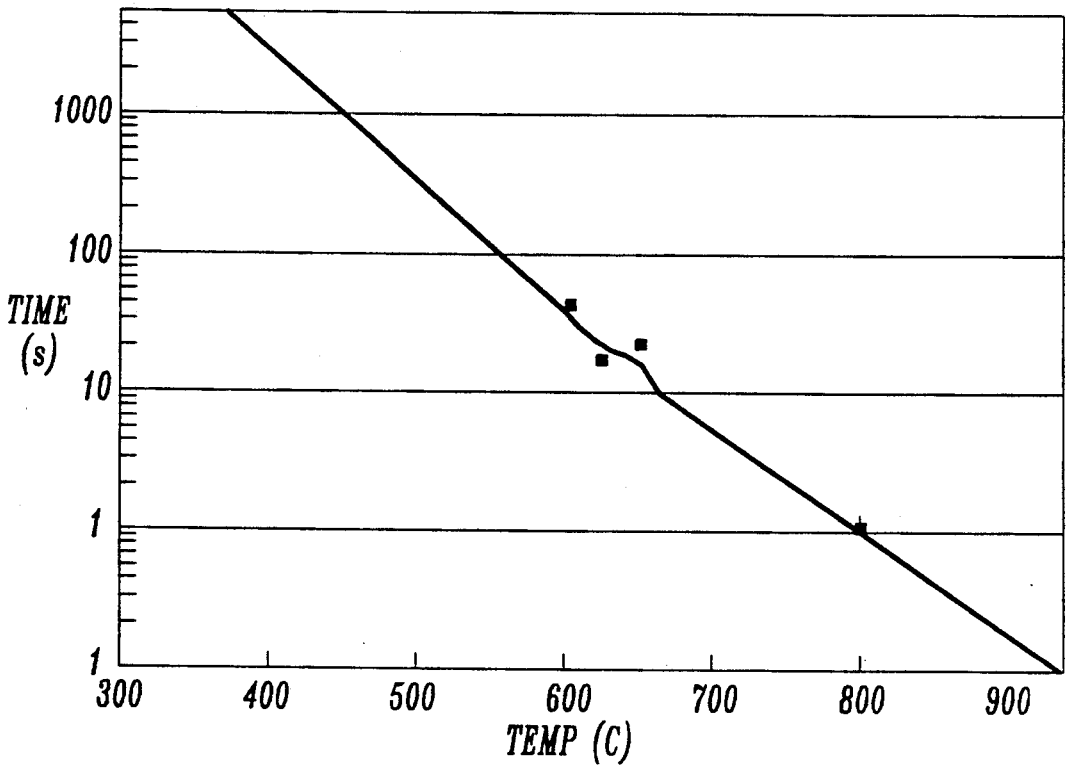
FIG. 3 is a chart of PdNi plating crystallinity transition in terms of time in seconds on a log scale versus temperature in degrees centigrade for a 300° to 1000° C. zone.
Figure 4:
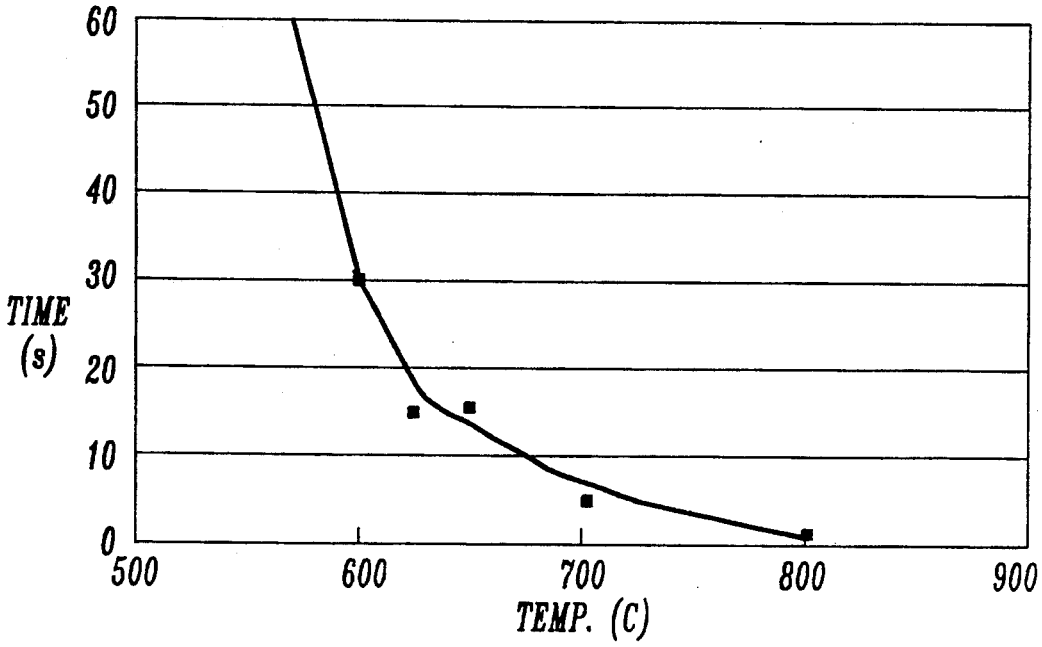
FIG. 4 is a chart of PdNi plating crystallinity transition in terms of time in seconds versus temperature in degrees centigrade for a 500°–900° C. zone.
Figure 5:
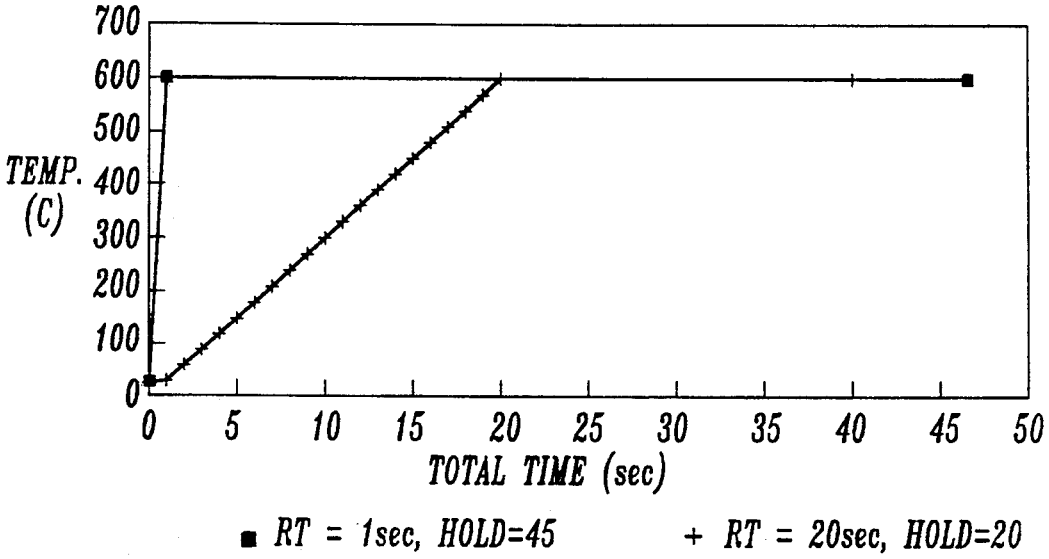
FIG. 5 is a chart of an operating window in terms of temperature in degrees C. versus time in seconds for a RTA of PdNi alloy at 600° C.
Figure 6:
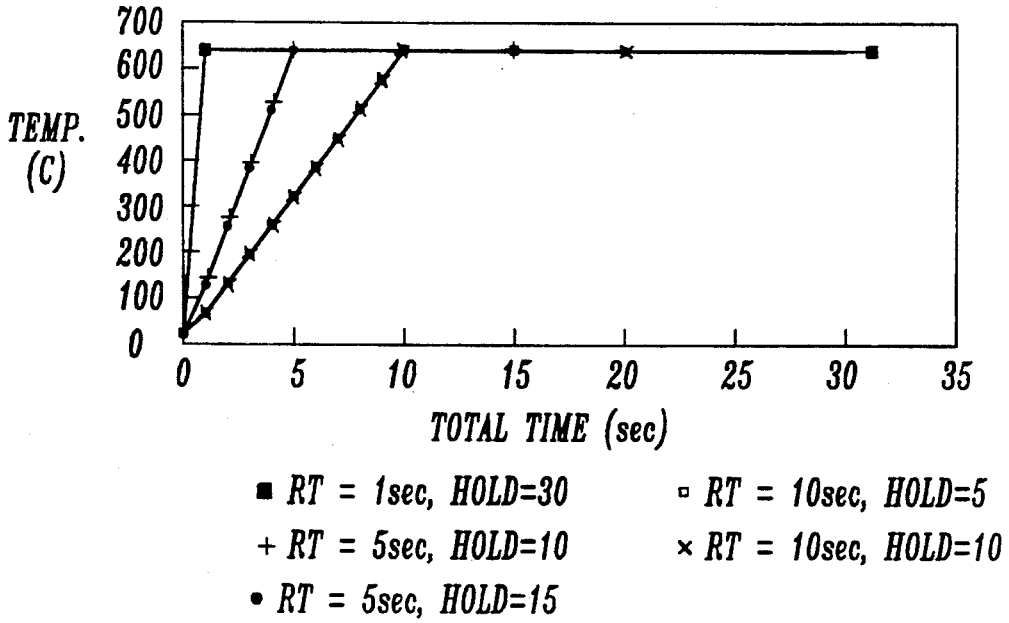
FIG. 6 is a chart of an operating window in terms of temperature in degrees C. versus time in seconds for a RTA of PdNi alloy at 625° C.
Figure 7:
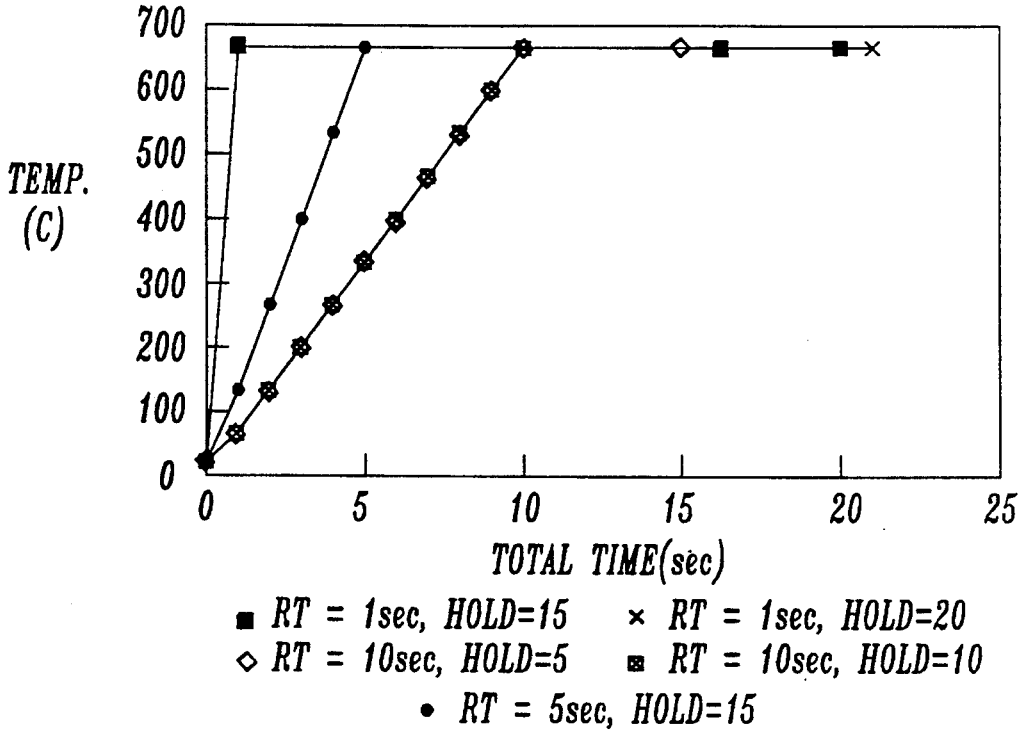
FIG. 7 is a chart of an operating window in terms of temperature in degrees C. versus time in seconds for a RTA of PdNi alloy at 650° C.
Figure 8:
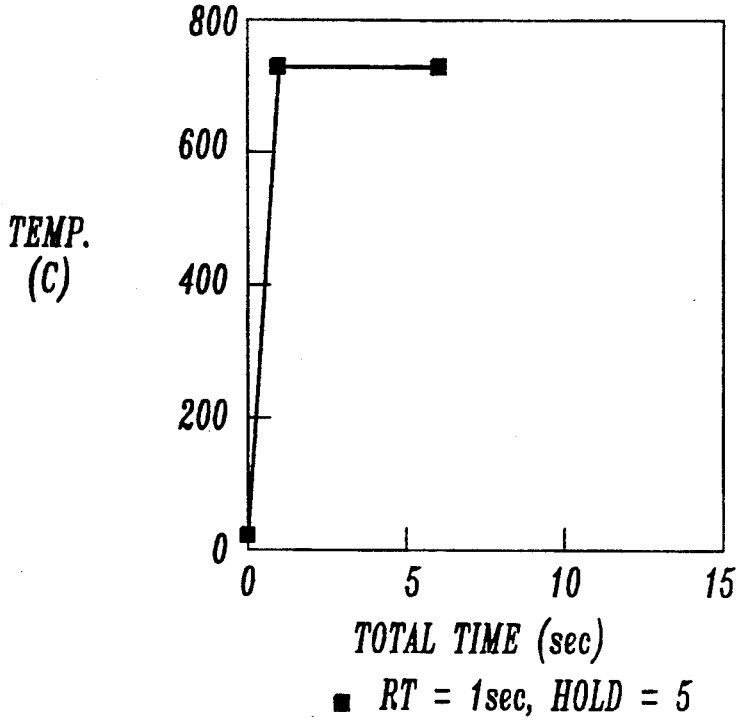
FIG. 8 is a chart of an operating window in terms of temperature in degrees C. versus time in seconds for a RTA of PdNi alloy at 725° C.
Figure 9:
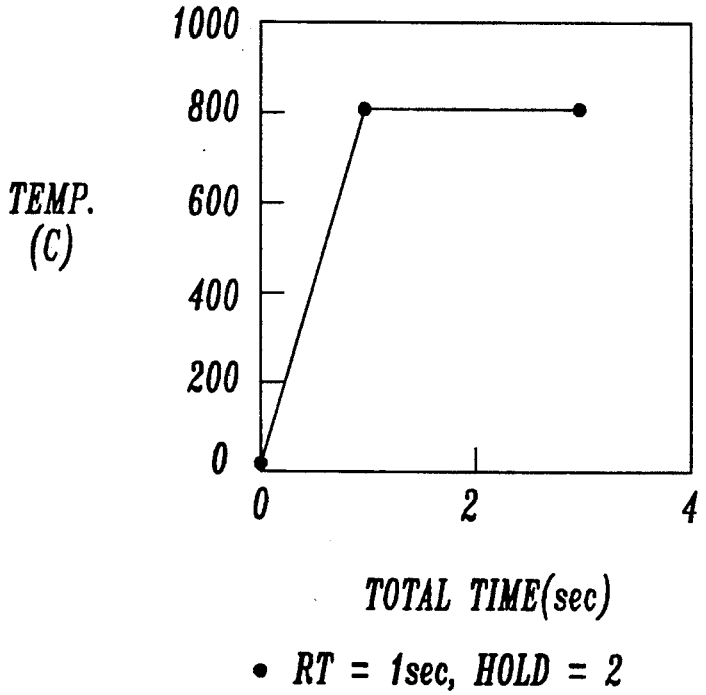
FIG. 9 is a chart of an operating window in terms of temperature in degrees C. versus time in seconds for a RTA of PdNi alloy at 800° C.

Graphical presentation of the information directed to time and temperature relation in the PdNi alloy thermal annealing is shown in FIGS. 3 and 4 of the drawings. The solid curve line represents a boundary between the fine crystallites of the PdNi electroplated alloy, as electroplated with 6–10% elongation capability, to the left of (or below) the boundary and enlarged crystallinities with greater than 10%, e.g. 10–20%, elongation capabilities, to the right of (or above) the boundary. A PdNi alloy heat-treated at a selected temperature for total time of heat-treatment represented by a point of intersection on the boundary defined by the curve, shall be crack free. Above this boundary the alloy shall remain crack free; however, the material of the substrate when heated beyond the limits of temperature and time representing an operating window for the material, may begin to loose its spring.

Below 500° C., the time needed to achieve any annealing of the PdNi alloy coating exceeds several minutes. While this time of processing could be acceptable for batch operations, these conditions may be unacceptable for in-line plating and annealing of plated articles. The annealing involves rise from a room temperature to a hold temperature, e.g. 500° C. and then holding the body at that temperature. For example, the total time requirement at 500° C. is about 120 seconds; if it takes 10 seconds to raise the temperature of the body to 500° C., then another 110 seconds at that temperature are needed to fully anneal the PdNi deposit. It is seen that at 400° C., the total treatment time may add-up to about 3000 seconds before the plated deposit shall become crack-free.

Within a range of from 575° C. up to 725° C. lies a zone of exposure times (rise time and hold time combined) exceptionally well suited for the RTA. At 600° C. the total exposure temperature time is between 25 to 30 seconds, while at higher temperatures it drops down to a few seconds at 725 deg C. At temperatures above 725° C. the process becomes almost impractical due to the short time involved in processing. Thermal treatment at these higher temperatures may quickly lead to annealing of both, the substrate and the coating, and may make the product unacceptable due to the loss of spring in the substrate.

FIGS. 5–9 are graphic representations of operating windows for the copper-nickel-tin alloy 725 substrate at 600°, 625°, 650°, 725° and 800° C., respectively. Upper limits of time in these charts suggest the permissible time of annealing the device at these select temperatures beyond the boundary curve of FIG. 3, before the onset of loss of spring in the substrate material. Similar windows may be developed for other temperatures as well as for other substrate materials by simple trial-and-error technique.

In Table I, below, are shown some of the RTA treatment effects on the performance of PdNi alloy (80 Pd-20Ni) electroplated deposit on the 725 copper alloy substrate.

TABLE I

RTA TREATMENT EFFECT ON PdNi PLATE PERFORMANCE

| Temp. (deg. C.) | Rise Time (s) | Hold Time (s) | Cracks yes/no | Spring OK/lost | % El. |
|---|---|---|---|---|---|
| 500 | 10 | 20 | yes | OK | |
| | 20 | 20 | yes | OK | |
| | 30 | 10 | yes | OK | |
| | 30 | 30 | yes | OK | 5.1–9.3 |
| 600 | 10 | 20 | no | OK | |
| | 20 | 20 | no | OK | |
| 625 | 1 | 10 | yes/slight | OK | |
| | 1 | 20 | yes/slight | OK | |
| | 1 | 30 | no | OK | 10.7–16.9 |
| | 5 | 5 | yes | OK | |
| | 5 | 10 | no | OK | |
| | 5 | 15 | no | OK | |
| | 10 | 10 | no | OK | |
| 650 | 1 | 5 | yes | OK | |
| | 1 | 10 | yes/slight | OK | |
| | 1 | 15 | no | OK | |
| | 1 | 20 | no | OK | 12.7–20.2 |
| | 5 | 5 | yes | OK | |
| | 5 | 10 | yes/slight | OK | |
| | 5 | 15 | no | OK | |
| 700 | 1 | 5 | no | lost/slight | |
| | 1 | 10 | no | lost | |
| | 10 | 10 | no | lost | |
| 800 | 1 | 1 | no | lost/slight | |
| | 1 | 2 | no | lost | |
| | 1 | 3 | no | lost | |

We claim:

1. The process of fabricating an electrical device having at least one contact comprising a conductive region, which comprises, electroplating on at least a portion of a metal base a plated deposit layer comprising from 20 to 80 mole percent palladium remainder nickel, subjecting at least the plated portion to an annealing process, permitting the annealed sample to cool to room temperature, and forming the plated metal base into a desired form, said annealing and cooling steps being conducted in an inert atmosphere, wherein, prior to said forming step, at least the plated portion is subjected to an annealing process, said annealing is a Rapid Thermal Anneal (RTA) heat treatment which comprises raising the plated portion from the plating temperature to a temperature within a range from 575° to 800° C. within a period of time ranging from 1 second to 30 seconds and maintaining the plated portion at said holding temperature for a period of from 1 to 30 seconds, the total time of heat-treatment being sufficient to anneal the plated deposit so as to eliminate cracking of the deposit as the result of the forming step but insufficient to result in the loss of spring in the metal base.

2. The process of claim 1 in which said palladium nickel alloy is plated on a surface of a layer of nickel on the metal base.

3. The process of claim 1 in which the conductive region comprises, sequentially from the metal base, a layer of nickel, a layer of palladium nickel alloy and a flash coating comprising gold.

4. The process of claim 3, in which said metal base is of copper-nickel-tin alloy, said nickel layer is 50–70 micro-inch thick, said palladium nickel alloy layer is 20–30 micro-inch thick, and said flash coating comprising gold is 3–5 micro-inch thick.

5. The process of claim 1 in which the metal base comprises a copper-nickel-tin alloy.

6. The process of claim 1, in which said forming includes bending of the plated portion of the metal base so as to result in an elongation of the palladium alloy deposit of at least ten percent.

7. The process of claim 1, in which said forming includes rolling of the plated portion about a mandrel with a diameter of less than 2 mm, the plated palladium alloy being on the inside of the rolled portion.

8. The process of claim 1, in which said atmosphere comprises at least one gas selected from the group consisting of nitrogen, argon, helium and xenon.

* * * * *